US009605933B2

(12) United States Patent
Pedersen

(10) Patent No.: US 9,605,933 B2
(45) **Date of Patent: *Mar. 28, 2017**

(54) EXPANDABLE BROADHEAD

(71) Applicant: Out RAGE, LLC, Superior, WI (US)

(72) Inventor: William E. Pedersen, Duluth, MN (US)

(73) Assignee: FeraDyne Outdoors, LLC, Superior, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/863,601

(22) Filed: Sep. 24, 2015

(65) Prior Publication Data

US 2016/0010962 A1 Jan. 14, 2016

Related U.S. Application Data

(63) Continuation of application No. 13/998,888, filed on Dec. 18, 2013, now Pat. No. 9,170,078.

(51) Int. Cl.
*F42B 6/08* (2006.01)
*F42B 12/34* (2006.01)

(52) U.S. Cl.
CPC ..... *F42B 6/08* (2013.01); *F42B 12/34* (2013.01)

(58) Field of Classification Search
CPC ..... F42B 6/08
See application file for complete search history.

(56) References Cited

U.S. PATENT DOCUMENTS

| | | | |
|---|---|---|---|
| 2,289,284 | A | 7/1942 | Chandler |
| 2,568,417 | A | 9/1951 | Steinbacher |
| 2,859,970 | A | 11/1958 | Doonan |
| 3,036,395 | A | 5/1962 | Nelson |
| 3,036,396 | A | 5/1962 | Swails |
| 3,138,383 | A | 6/1964 | McKinzie |
| 3,578,328 | A | 5/1971 | Rickey |
| 3,618,948 | A | 11/1971 | McGlocklin |
| 3,738,657 | A | 6/1973 | Cox |
| 4,099,720 | A | 7/1978 | Zeren |
| 4,166,619 | A | 9/1979 | Bergmann et al. |
| 4,405,133 | A | 9/1983 | Cartwright, Jr. |
| 4,579,348 | A | 4/1986 | Jones |
| 4,615,529 | A | 10/1986 | Vocal |

(Continued)

OTHER PUBLICATIONS

Action Closing Prosecution (nonfinal), mailed by the USPTO on May 21, 2102 in case Control No. 95/001,854 filed Dec. 14, 2011.

(Continued)

*Primary Examiner* — John Ricci
(74) *Attorney, Agent, or Firm* — Winthrop & Weinstine, PA

(57) ABSTRACT

An expandable broadhead includes a number of fixed blades cumulating in a point, with each of the fixed blades having a channel for receiving a cammable deployable expansion blade, with the expansion blade having a slot which cooperates with a fixed retaining pin transverse to the channel that cams the deployable blade outwardly when a forward impact shoulder of the deployable blade strikes a target. This moves the blade relative to the fixed retaining pin and thus cams the deployable blade out to an expanded position for maximum blade cutting edge contact to effectuate maximum damage to the target and a quick kill.

5 Claims, 12 Drawing Sheets

(56) References Cited

U.S. PATENT DOCUMENTS

| | | | | |
|---|---|---|---|---|
| 4,932,671 | A | 6/1990 | Anderson, Jr. | |
| 4,940,246 | A | 7/1990 | Stagg | |
| 4,973,060 | A | 11/1990 | Herzing | |
| 4,976,443 | A | 12/1990 | DeLucia | |
| 4,998,738 | A | 3/1991 | Puckett | |
| 5,046,744 | A | 9/1991 | Eddy | |
| 5,066,021 | A | 11/1991 | DeLucia | |
| 5,078,407 | A | 1/1992 | Carlston et al. | |
| 5,082,292 | A | 1/1992 | Puckett et al. | |
| 5,100,143 | A | 3/1992 | Puckett | |
| 5,178,398 | A | 1/1993 | Eddy | |
| 5,286,035 | A | 2/1994 | Ward | |
| 5,458,341 | A | 10/1995 | Forrest et al. | |
| 5,472,213 | A | 12/1995 | Dudley | |
| 5,564,713 | A | 10/1996 | Mizek et al. | |
| 5,803,844 | A | 9/1998 | Anderson | |
| 5,803,845 | A | 9/1998 | Anderson | |
| 5,820,498 | A | 10/1998 | Maleski | |
| 5,857,930 | A | 1/1999 | Troncoso | |
| 5,879,252 | A | 3/1999 | Johnson | |
| 5,941,784 | A | 8/1999 | Mizek | |
| 6,015,357 | A | 1/2000 | Rizza | |
| 6,077,179 | A | 6/2000 | Liechty, II | |
| 6,165,086 | A | 12/2000 | Liechty, II | |
| 6,171,206 | B1 | 1/2001 | Liechty, II | |
| 6,174,252 | B1 | 1/2001 | Mizek | |
| 6,200,237 | B1 | 3/2001 | Barrie | |
| 6,217,467 | B1 | 4/2001 | Maleski | |
| 6,258,000 | B1 | 7/2001 | Liechty, II | |
| 6,270,435 | B1 | 8/2001 | Sodaro | |
| 6,283,880 | B1 | 9/2001 | Barrie | |
| 6,287,223 | B1 | 9/2001 | Liechty, II | |
| 6,322,464 | B1 | 11/2001 | Sestak | |
| 6,517,454 | B2 | 2/2003 | Barrie et al. | |
| 6,554,727 | B1 | 4/2003 | Armstrong et al. | |
| 6,626,776 | B2 | 9/2003 | Barrie et al. | |
| 6,669,586 | B2 | 12/2003 | Barrie et al. | |
| 6,755,758 | B2 | 6/2004 | Liechty, II | |
| 6,830,523 | B1 | 12/2004 | Kuhn | |
| 6,910,979 | B2 | 6/2005 | Barrie et al. | |
| 6,935,976 | B1 | 8/2005 | Grace, Jr. et al. | |
| 7,713,151 | B2 | 5/2010 | Fulton | |
| 7,905,802 | B2 | 3/2011 | Erhard | |
| 8,398,510 | B1 | 3/2013 | Mizek et al. | |
| 8,469,842 | B2 | 6/2013 | Mizek et al. | |
| 8,469,843 | B2 | 6/2013 | Mizek et al. | |
| 8,758,176 | B2 | 6/2014 | Pedersen | |
| 8,974,327 | B2 * | 3/2015 | Priore | F42B 6/08 473/583 |
| 9,170,078 | B2 * | 10/2015 | Pedersen | F42B 12/34 |
| 2001/0036876 | A1 | 11/2001 | Barrie et al. | |
| 2003/0004021 | A1 | 1/2003 | Barrie et al. | |
| 2003/0153417 | A1 | 8/2003 | Barrie et al. | |

OTHER PUBLICATIONS

Bowhuntinq Equipment Buyers Guide, 1997, 3pp.
"Bowhunting Tactics," Petersen's Bowhunting Magazine, Oct. 18, 2004, 5 pp., www.outdoorsbest.com.
Bowhunting World, Feb. 1997, 2 pp.
Bowhunting World: Bowhunting Guide '89-'90, vol. 38, No. 7, 2 pp., 1989-1990 edition.
Bowhunting World: Equipment Guide '94, vol. 43, No. 5, Jul. 1994, 3 pp.
"Broadhead Collecting—As Easy As A.B.C.C.," Stickbow.com, Copyright 2002, 8 pp.
D. H. Pauley letter to R. L. Rainey regarding Reissue U.S. Appl. No. 11/823,458; letter dated Aug. 2, 2011.
D. H. Pauley letter to R. L. Rainey regarding Reissue U.S. Appl. No. 11/823,458; letter dated Aug. 31, 2011.
Declaration of Andy Simo to Establish date of Invention Prior to Critical date of U.S. Appl. No. 11/823,458; Declaration dated Aug. 31, 2011.
Declaration of Bob Mizek to Establish date of Invention Prior to Critical date of U.S. Appl. No. 11/823,458; Declaration dated Aug. 31, 2011.
Declaration of Chris Kozlik to Establish date of Invention Prior to Critical date of U.S. Appl. No. 11/823,458; Declaration dated Aug. 31, 2011.
Email from A. Simo to R. Krause, dated Sep. 14, 2011.
Email from A. Simo to R. Krause, dated Sep. 19, 2011, and related emails.
Email from Andy Simo to Rich Krause, dated Sep. 28, 2011.
Email from D. Pauley to G. Discher, dated Sep. 13, 2011.
Email from J. Fowler to D. Pauley, dated Aug. 19, 2011, and related emails.
Email from R. Krause to A. Simo, dated Sep. 16, 2011.
Email from R. Krause to A. Simo, dated Sep. 20, 2011.
Email from R. Krause to A. Simo, dated Sep. 28, 2011, and related email.
Email from rmizek@newarchery to B. Barrie, re: Amo Show; dated Jan. 30, 2001.
Email with two (2) attachments from A. Simo to R. Krause, dated Sep. 22, 2011.
*Field Logic* v. *G5 Outdoors*, No. 06cv01724 Defendant's Prior Art Chart (12 pages), dated Jun. 27, 2007.
New Archery Products Corp. ("NAP"), letter from A. Simo to R. Krause regarding U.S. Pat. Nos. 6,517,454, 6,626,776, and 6,910,979; letter dated Jul. 22, 2011.
"New Products for 1997," Rich Walton's Industry News, 9 pp., http://www.bowhunting.net/richwalton/97newproducts.html.
Order for Dismissal Without Predudice, May 8, 2009.
Petition Under 37 C.F.R. § 1.182 and/or § 1.183, a Protest Under 37 C.F.R. § 1.291(a) with Exhibits 1-5, and Declaration of Robert Mizek Under 37 C.F.R. § 1.132, initially submitted to the USPTO on Jan. 31, 2012 by Mr. Allan A. Fanucci.
Plaintiff Out Rage LLC's Identification of Asserted Claims and Accused Products, dated Feb. 3, 2012.
R. L. Rainey letter to A. Simo, dated Aug. 1, 2011.
R. L. Rainey letter to D. H. Pauley, dated Aug. 17, 2011.
Request for Inter Partes Reexamination of U.S. Pat. No. 6,626,776, filed Dec. 14, 2011.
Response to Office Action in Inter Partes Reexamination under 37 C.F.R. § 1.945 and M.P.E.P. § 2666, filed in the USPTO on Mar. 28, 2102 in Control No. 95/001,854 filed Dec. 14, 2011.
Stipulation for Dismissal Without Predudice, May 6, 2009.
Third Party Requester's Comments to Patent Owner's Reply of Mar. 28, 2012 Pursuant to 37 C.F.R. § 1.947, dated Apr. 27, 2012.
Two photographs which are duplications of original photograph, taken of expandable broadheads of the same construction as those that were shown in the photograph provided with the email from rmizek@newarchery to B. Barrie, dated Jan. 30, 2001.

* cited by examiner

EXPANDABLE BROADHEAD

CROSS-REFERENCE TO RELATED APPLICATIONS

This application is a continuation, and claims the benefit under 35 U.S.C. §120, of U.S. patent application Ser. No. 13/998,888, filed Dec. 18, 2013, which is herein incorporated by reference in its entirety.

FIELD OF THE INVENTION

This invention relates to expandable broadheads and more particularly to rear deploying expandable broadhead blades which rotate and translate on a pin located on fixed blades.

BACKGROUND OF THE INVENTION

Expandable broadheads that mate with an arrow and include a plurality of blades that are shiftable between a retracted inflight position and an extended penetrating position are exemplified in reissue Pat. RE 44,144 reissued on Apr. 9, 2013, the contents of which are incorporated herein by reference.

In this patent a broadhead having a number of expandable blades is disclosed in which the broadhead is manufactured with a central ferrule which contains moveable blades within the ferrule that are extended outwardly upon impact of the broadhead with a target. Note that the blade cutting surfaces point out when in flight or deployed. In one embodiment in the retracted position the blades are contained within a blade recess in the form of a slot or a groove within the broadhead ferrule and move outwardly by translating along the surfaces of the slot to cam the blades to an extended position. It will be noted that this type of expandable broadhead and indeed many others provide for the blades housed within slots in a solid ferrule.

While these broadheads are exceptionally useful in bowhunting and indeed in bowfishing, on occasion the blades will stick or bind in the ferrule slots such that the blades do not extend upon impact. Moreover, due to the relatively large bullet-like tip of the ferrule the penetration of the arrow into the target is limited by the diameter of the tip. The result is that penetrating power of these broadheads is unnecessarily limited.

Moreover, for some expandable broadhead configurations the expandable blades may extend during flight resulting in poor aiming accuracy and causing the arrow to go off course both due to aerodynamic turbulence and due to the severe effect of crosswinds on the broadhead structure itself.

While the aforementioned expandable broadheads contain at least a portion of the expandable blades within a solid ferrule, as illustrated in U.S. Pat. No. 4,615,529 extensible blades are pivoted on the fixed blades of a broadhead. However, as can be seen in this patent the extensible blades are limited to pivoting deployment from a forward pivoted location with the cutting edges pointing toward the ferrule. This means that the blades are pivoted on the fixed arrow blade such that rather than moving from an inflight retracted position running aft, they extend from a forward facing position. This means that the blades on the fixed blades pivot from a forward collapsed position to a transverse final position. As such the blades are not cammably deployable. This type of configuration is subject to unintentional opening of the pivoted blades due to the air flow over the arrow in flight, thus decreasing penetrating power as well as causing aerodynamic instabilities which cause the arrow to go off track, to say nothing of crosswind and turbulence effects on the arrow flight path. If the blades are sufficiently constrained that they do not deploy early, then the energy necessary to cause them to pivot to the cutting position is significant in that it greatly reduces the penetration of the arrowhead. This type of broadhead is commonly referred to as a "over the top expandable" broadhead.

This type of configuration in which a fixed arrow blade is provided with over the top deploying secondary blades is also exemplified by the SteelForce Phat Head SOB4-blade broadhead that is presently available. This broadhead has a fixed blade structure to which there are pivoted forward facing moveable blades having tips which extend outwardly past the fixed blade edges. When the arrow enters the target the tips of the moveable blades are pushed outwardly as they enter the target until they rest on a stop at which point they are extended to the full extent. This SteelForce broadhead suffers the same problems as mentioned above with respect to U.S. Pat. No. 4,615,529.

Expandable broadheads are commonly made with either two or more expandable blades. With blades in a configuration with more than two moveable blades, the geometry of the blade attachment point becomes critical. If the pivot location of the blades is close to the primary axis of the ferrule, simultaneous blade rotation allows for the blades to interfere with the motion of one another. This interference is possible both during deployment, as well as during retraction of the arrow from the target. During deployment, if the blades run into one another it can potentially prevent full deployment of the blades. During removal of the arrow from the target, the rotatable blades can interfere with one another and jam in a mid-position, causing a barbing situation which is currently illegal in many jurisdictions. An exemplary broadhead is that mentioned above in U.S. Pat. RE 44,144.

In short there is a necessity to provide an improved expandable broadhead design using a rear deploying expandable blade structure that does not hang up or get stuck in a ferrule slot while at the same time improving penetration capabilities as well as making arrow removal easy after target penetration. Moreover, blade-to-blade interference upon expansion is to be avoided. Most important is the problem of providing a broadhead with rear deployable blades that are made reliable by rotating and translating them on fixed blades such that the cutting power associated with the fixed blades is augmented by the rear deployed blades so as to provide expanded target cutting impact.

SUMMARY OF INVENTION

Rather than providing ferrules with notches, slots or grooves into which are mounted extensible or expandable blades, in the subject invention the broadhead is provided with a number of fixed blades culminating in a sharp needle-like point, with the fixed blades provided with deployable auxiliary blades rotatably and translatably mounted on the fixed blade, the moveable blades being rear deploying and having cutting edges pointing outwardly when in flight. In one embodiment the deployable blade is disposed in a channel in the fixed blade, with the deployable auxiliary blade having a slot that cooperates with a fixed blade retaining pin transverse to the channel in the fixed blade such that a forward shoulder of the deployable blade when striking a target moves the blade aft, with the slot in the blade translating and rotating on the fixed retaining pin in the fixed blade. In one embodiment with a rear fixed camming surface is located on the ferrule or a component of the broadhead fixedly mounted to the ferrule to further cam the movable blade to its outer deployed position when a rear camming surface on the movable blade cams on the fixed camming surface. The channels in the fixed blades are of sufficient width to carry the deployable blades in a loose fit, thereby precluding jamming.

Moreover, the reason that the subject cammable mechanical broadhead is an improvement over current art is that the location of the blade retaining pin being in the fixed blade allows for a greater clearance between blades when they are in the partially deployed state. By moving the pin location radially outward from the central axis of the broadhead, it provides a greater allowed swing circle for the tops of the moveable blades such that the travel of the blades as they rotate and translate between the closed in flight condition and the fully deployed position does not result in blade collision. The preferred embodiment has a slot in the fixed blade at a radial distance of 0.328" from the ferrule centerline; the maximum swing circle of the farthest point on the impact shoulder of the auxiliary blades from its most extreme rotational position is 0.283". The combination of these two measurements does not allow for the blades to impede the motion of one another when the auxiliary blades are in an intermediate position. It should be readily apparent that there would be an infinite combination of swing circle and radial slot distance that could be made to work. The key innovation is that the slot in the fixed blades allow for the slots to move farther from the centerline of the broadhead than would be practical with the slot in the ferrule body. A typical maximum radius of a current ferrule would be 0.160", which is significantly less than the preferred 0.283" enabled by placing the slot in the fixed blades attached or part of the ferrule of the broadhead. During deployment this is important because it prevents the blades from running into one another and potentially preventing full deployment. After the arrow has stopped moving within the target, the offset pin arrangement is important because when the arrow is pulled to retract the head from the target, the blades are free to rotate without interference with one another, preventing the blades from jamming on one another thus preventing "barbing".

Because the fixed blades culminate in a very small needle-like chisel point, with the point being reinforced by the fixed blade material at the point, the penetration capability of the subject expandable broadhead is increased markedly over broadheads which have a considerable ferrule point diameter.

In one embodiment a shock collar aft of the deployable blades includes a frangible tab that is used to retain the blades in flight, but breaks free to allow for blade deployment upon striking the target. The shock collar design in this invention is an improvement over the previous shock collar detailed in U.S. patent application Ser. No. 13/736,680 incorporated herein by reference because it allows for more than two movable blades. In one embodiment when the blades strike a target and are moved aft they cam on a fixed camming surface or extrusion on a specialty washer, or an extrusion from the ferrule itself that allows for camming of the rear camming surface of the blades against the fixed camming surface of the specialty washer or ferrule extrusion.

The operable coupling of these components results in the outward rotation of the blades as they translate rearwardly along the axis of the ferrule. Once the blades have completed their translation and rotation around their fixed pin, they will then seat against this extrusion or camming surface in either the ferrule or the specialty washer to prevent the blades from rotating back in toward the ferrule axis. The preferred embodiment has a specialty washer that seats within the shock collar. The specialty washer can be made from materials of high strength such as steel, titanium, aluminum, or other suitably strong and tough material while the shock collar is preferably be made from a strong, yet more brittle material that will allow for the retaining tab in this collar to break upon target impact. Exemplary suitable materials for the shock collar are polypropylene, nylon, glass filled nylon, cast aluminum, aluminum oxide, or other suitable materials.

In order to prevent jamming of the blades in their respective channels in the fixed blades, the retaining pin utilized as the fixed pin lies transverse to the channel in the fixed blade and is screwed into threads on either side of the channel in the fixed blade, with the pin utilized to mount the blades in their respective fixed blade channels. In one embodiment the pins have threads at either end, but are provided with a central portion which is unthreaded to provide maximum clearance for the translation and rotation of the extensible blades unimpeded with screw threads. The lack of threads in this portion of the retaining pin prevents damage to any threads during the impact of blades slapping back. If the pin were fully threaded, threads on the shaft of the retaining pin could get damaged during this impact and the retaining pin would become jammed within the ferrule and therefore potentially prevent replacement of the moveable blades.

It is noted that each of the extensible blades has a forward impact shoulder that is adapted to contact the target when the broadhead pierces the target, with the shoulder moving rearwardly by the impact force. This drives the cammable blade rearwardly and against the retaining pin which cams the blade outwardly to an extended position. Thus, there is no separate mechanical actuating mechanism for the extension or expansion of the deployable blades other than the forward impact shoulder of the deployable blade itself.

Moreover due to the translation and rotation of the movable blades on the fixed blades at a radial distance from the centerline of the broadhead, under no circumstance will one blade contact an adjacent blade when deploying, such that blade expansion or deployment is completely interference free between the blades.

While there are broadheads designed to weigh more, it will be appreciated that in broadheads it is commonly desirable to keep the weight of the broadhead under 100 grains in which one grain, i.e. $1/7000$ of one pound. Therefore, in the design of a broadhead the amount of metal utilized is to be minimized. Oftentimes this minimization results in blades and ferrules that are fragile. When a broadhead strikes a target if the ferrule structure is too thin the ferrule will either crumple or bend and may even break or crack. Since the mechanical elements of the broadhead are designed to be as light as possible they operate just above the failure threshold when subjected to the high target impact forces.

While it is possible to remove material from the centers of either the fixed or moveable blades, there is nonetheless a potential problem with the thinness of the ferrule itself.

In order to keep the ferrule from bending during impact, the aft portion of the ferrule is provided with a light weight sleeve or collar that resists ferrule bending but is of a weight substantially less than the steel ferrule material itself. When this collar is made of a shock absorbing material such as nylon, in addition to protecting against bending during impact, this material cushions the camming surfaces on the collar against blade slap in which a rear cam following surface on the moveable blade cams off the camming surface on the collar during broadhead impact. Thus the collar provides both strength to the ferrule and shock absorption during broadhead impact.

To summarize, as weight is always a factor in broadheads the subject broadhead is also made light weight due to the light weight reinforcing collar that surrounds the thin ferrule. This light weight reinforcing collar includes a non-metal shock collar that bears the load associated with target penetration. In this broadhead design, weight constraints could not be met without having a shock collar to provide ferrule strength, in which the shock collar is made of a polymer, ceramic or composite to support the metallic ferrule structure.

In short, the light weight ferrule collar contributes to the light weight broadhead design It is noted that in supporting the ferrule using a light weight supporting collar the strength of the steel spine is coupled with less critical bearing surfaces such as nylon to allow the broadhead to satisfy weight requirements while offering shock absorbing and the strength required when the broadhead strikes a target.

The above weight considerations are also important for the tip design. It is obviously important that the tip not crumple on impact and this can be solved by merely increasing the mass of the ferrule tip. However, this reduces penetrating power due to the larger cross section of material that must pass through the target. By machining the fixed blades from the block of material from which the ferrule is fabricated one can manufacture a reinforced needle-like chisel tip due to the adjacent surfaces of the fixed blades that meet in the point as well as reinforcing ribs between the fixed blades. Thus, a needle-like point can be manufactured by removing material from the ferrule point to decrease weight while at the same time providing a strong needle-like tip for improved penetration.

More particularly, note that in ferrule manufacture, machining down the length of the ferrule is designed to leave longitudinally running supporting ribs between the fixed blades, with the ribs running to the tip. In one embodiment, the tip is machined from a single piece of steel used for the ferrule. The machining thus creates the fixed blade as well as the longitudinally running rib. This process also creates a blade profile that removes most of the central materials reducing its cross section to a needle-like chisel point for penetration, noting that the removal of material reduces overall broadhead weight. As mentioned above, the machining leaves a strengthening rib down the outer radius of the remaining material surrounding the central axis of the tip to give the needle-like tip strength. Also because of a single bevel cutting edge fixed blade and the strengthening ribs down the middle between the fixed blades a reinforced needle-like tip is provided that can withstand tremendous forces so as to enhance penetration.

Note, by machining down the length of the ferrule, one can provide single bevel fixed blades which can achieve a blade sharpness that traditional chisel tips cannot achieve. The blade sharpness is dictated by the included angle of the sides of the blade. A three sided or Trocar tip cannot be sharpened effectively with a double bevel, i.e. sharpened on both sides. By using a single bevel, sharpened on one side, the included angle of the tip can be much smaller to provide the needle-like tip structure.

Moreover, in one embodiment the fixed pin is in the form of a fastener that goes through the ferrule or the channels in the fixed blades. The fastener or fixed pin is configured such that there is no way that the channel sides can be pinched together which would prevent blade deployment. Note also that in one embodiment the fastener is not externally exposed and therefore cannot be a source of additional drag as the broadhead penetrates the target.

In summary an expandable broadhead includes a number of fixed blades cumulating in a point, with each of the fixed blades having a channel for receiving a cammable deployable expansion blade, with the expansion blade having a slot which cooperates with a fixed retaining pin transverse to the channel that cams the deployable blade outwardly when a forward impact shoulder of the deployable blade strikes a target. This moves the blade relative to the fixed retaining pin and thus cams the deployable blade out to an expanded position for maximum blade cutting edge contact to effectuate maximum damage to the target and a quick kill.

BRIEF DESCRIPTION OF THE DRAWINGS

These and other features of the subject invention will be better understood in connection with the Detailed Description, in conjunction with the Drawings, of which.

DETAILED DESCRIPTION

Figure 1:
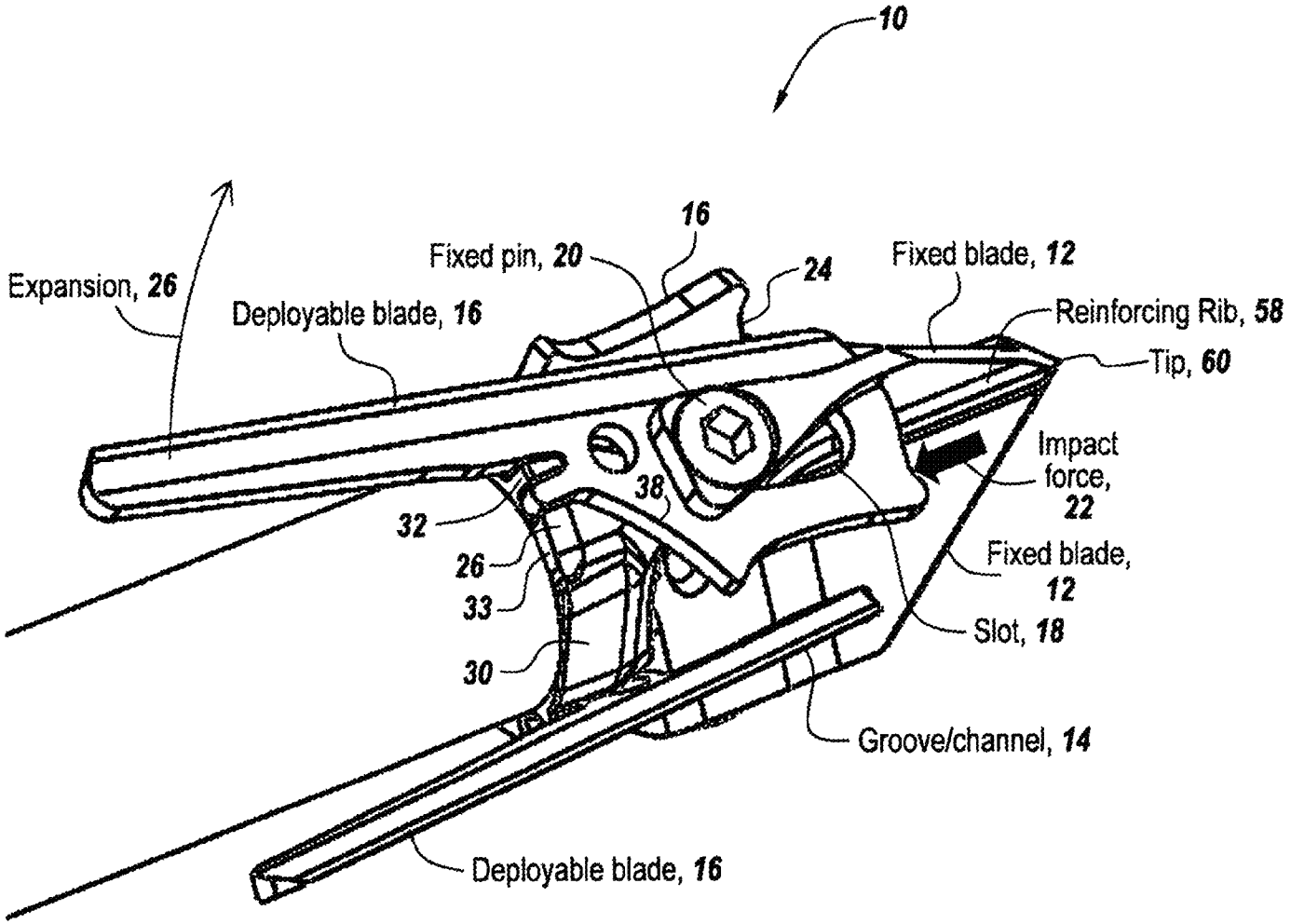
FIG. 1 is a diagrammatic illustration of a broadhead having a deployable blade mounted to a fixed blade through a retaining pin that extends through a channel in the fixed blade, indicating an impact force delivered to a forward shoulder on the deployable blade resulting in the swinging of the deployable blade away from the broadhead center line upon delivery of an impact force.

Referring now to FIG. 1, a broadhead 10 includes a number of fixed blades 12 each having a groove or channel 14 adapted to receive a movable deployable or auxiliary blade 16 therein. Each of the deployable blades has a longitudinally running slot 18, with a fixed retaining pin 20 utilized to retain the deployable blade in the associated channel of the fixed blade.

In operation, an impact force 22 impacts a forward impact shoulder 24 to move the deployable blade aft such that the relative position of the associated slot and the fixed retaining pin changes as the deployable blade moves aft. The result is that the deployable blade swing out to an expanded position as illustrated by expansion arrow 26 from an inflight position to an extended position due to the rotation and translation of slot 18 about fixed retaining pin 20.

In this view a shock collar 30 is utilized to strengthen the ferrule and absorb broadhead impact, with the deployable blades being locked in position due to a frangible tab 32 that coacts with a notch 34 in the aft portion of the deployable blade. When the deployable blade is moved aft this tab snaps off allowing the deployable blade to swing outward as illustrated by arrow 26 due to the rotation and translation deployable blade slot 18 about fixed retaining pin 20 that provides the primary camming action for extending the deployable blade upon exertion of impact force 22.

Additionally a specialty washer 33 has a camming surface 36 which coacts with a cam following surface 38 on the rear portion of deployable blade 16 that under certain circumstances further swings the deployable blade outwardly upon the aft motion of the deployable blade during impact. While in certain circumstances camming surface 36 may not engage cam following surface 38, often times in high impact situations the deployable blade will be moved fully aft and engage camming surface 36 on specialty washer 33.

Note that in the manufacturing of the ferrule a longitudinally camming rib positioned between fixed blades 12 serves to reinforce a needle-like tip 60 to prevent tip damage during target penetration. Thus the fixed blades that culminate in the tip and the reinforcing ribs permit an exceptionally sharp needle-like tips to be provided, capable of improved target penetration.

Figure 2A:
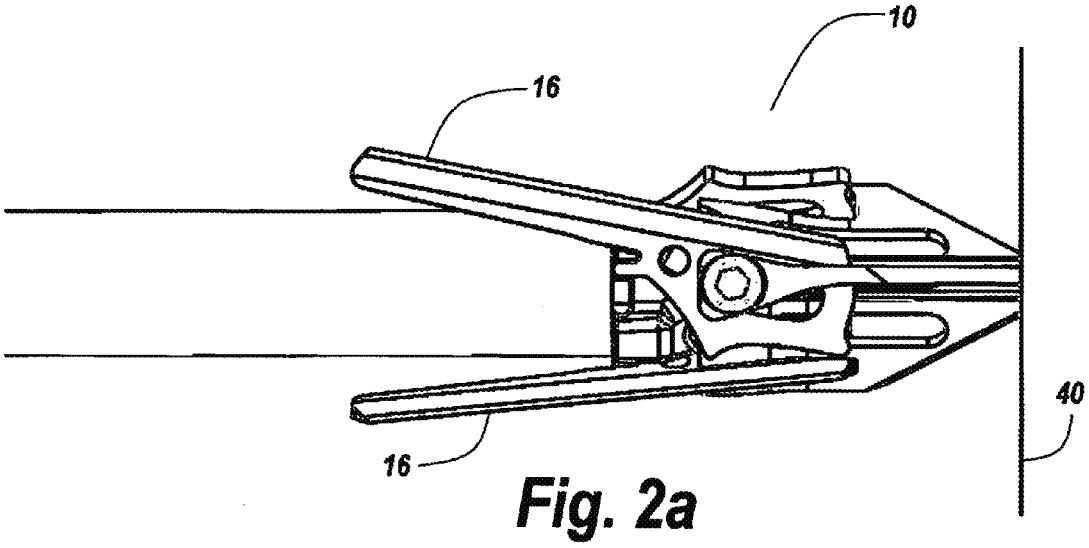
FIGS. 2A-2F illustrate the operation of the broadhead of FIG. 1 prior to impact and during impact at which point the forward shoulder moves the deployable blade aft so that it rotates and translates on a fixed retaining pin to cam the deployable blade from an inflight position to an extended position.

Referring to FIGS. 2A-2F, the operation of the subject broadhead is illustrated. As illustrated in FIG. 2A broadhead 10 is shown with deployable blades 16 in their inflight positions prior to broadhead 10 striking target 40.

Figure 2B:
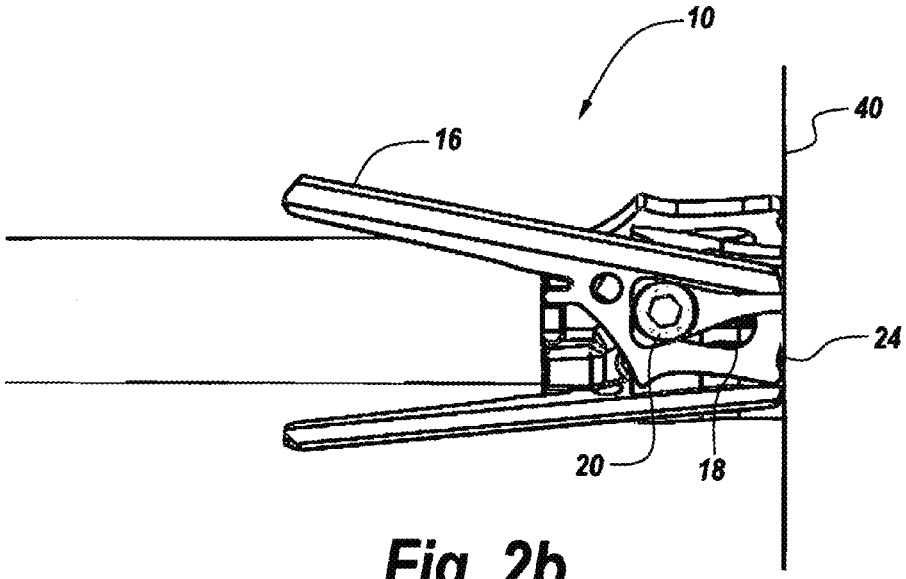

As illustrated in FIG. 2B as the broadhead 10 impacts target 40 forward shoulder 24 is moved aft to begin to swing deployable blade 16 outwardly due to the coaction of slot 18 which serves as a cam follower on the camming surface provided by retaining pin 20.

Figure 2C:
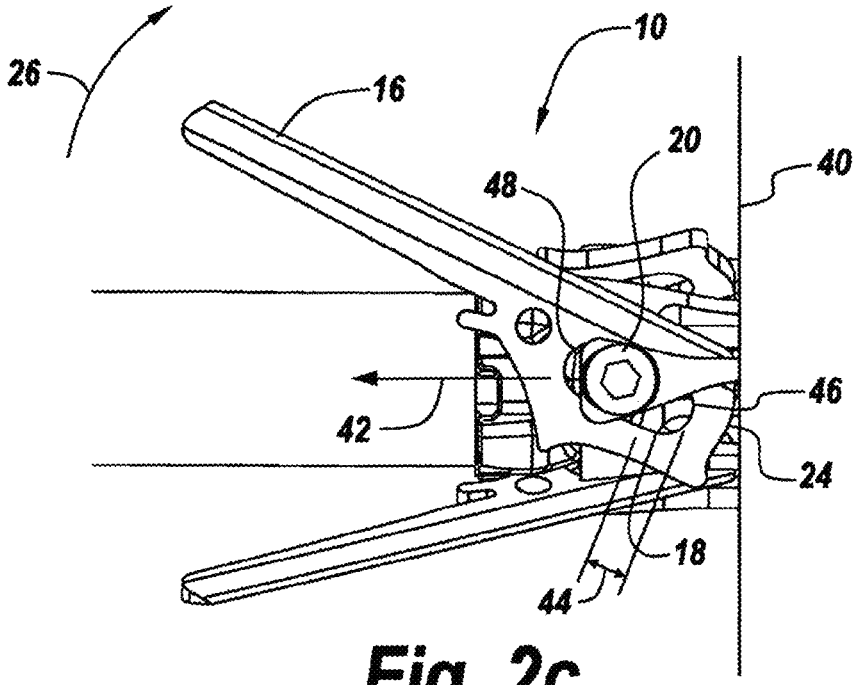

Referring to FIG. 2C, as the broadhead 10 moves in to further pierce target 40 the rear movement of deployable blade 16 is shown by arrow 42 which causes the distance 44 between the front end 46 of slot 18 and retaining pin 20 to decrease, with the retaining pin effectively moving towards forward shoulder 24 when viewed from the position of slot 18. Alternatively this action can be described by the movement of the deployable blade in the direction of arrow 42 which exposes more of the distal end 48 of slot 18 during broadhead penetration.

Figure 2D:
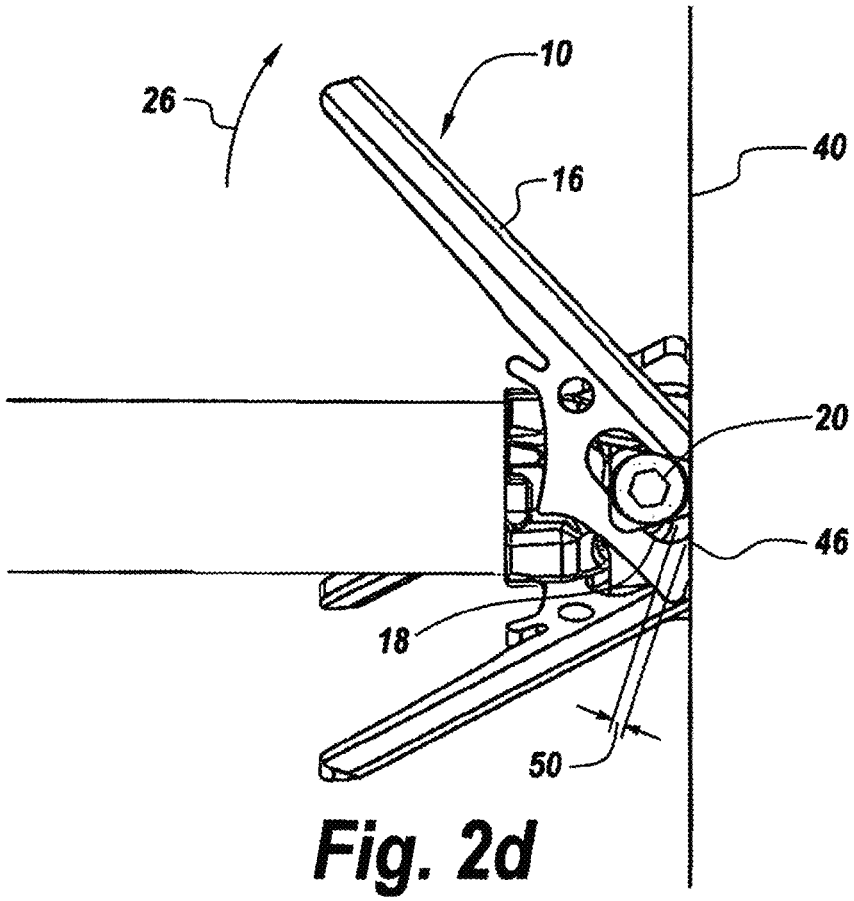

As can be seen from FIG. 2D the space between fixed retaining pin 20 and the front end 46 of slot 18 decreases as illustrated by double ended arrow 50 as the deployable blades 16 move in the direction of arrow 26 from the inflight position to the extended position, with the relative position of fixed retaining pin 20 and front slot end 46 decreasing. This causes the rotation and translation of the deployable blades outwardly so that they swing into their fully extended position.

Figure 2E:
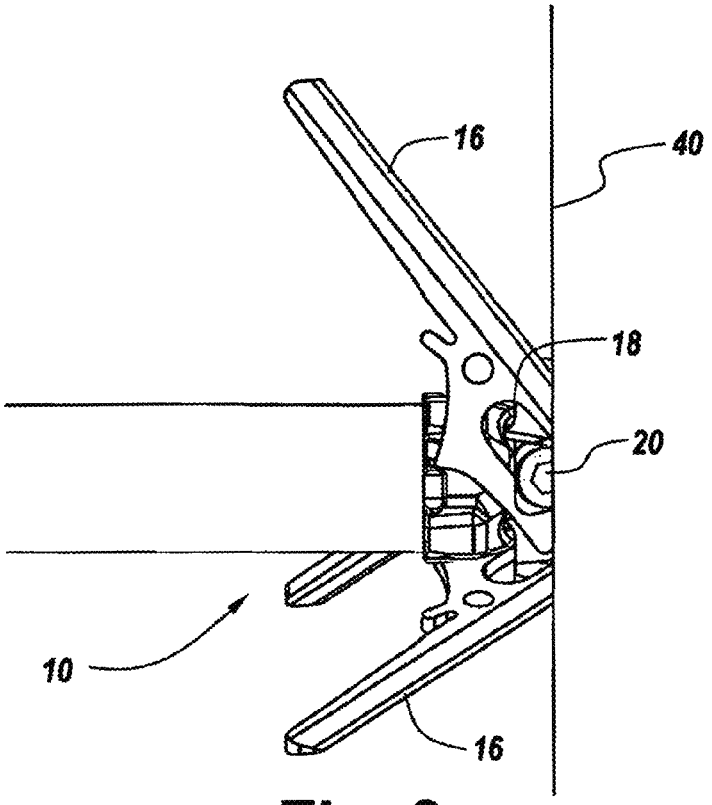

Referring to FIG. 2E, the fully extended position of deployable blade 16 is shown such that the fixed retaining pin 20 has now rests on the front end 46 of slot 18 leaving the exposed position of slot 18 as illustrated.

Figure 2F:
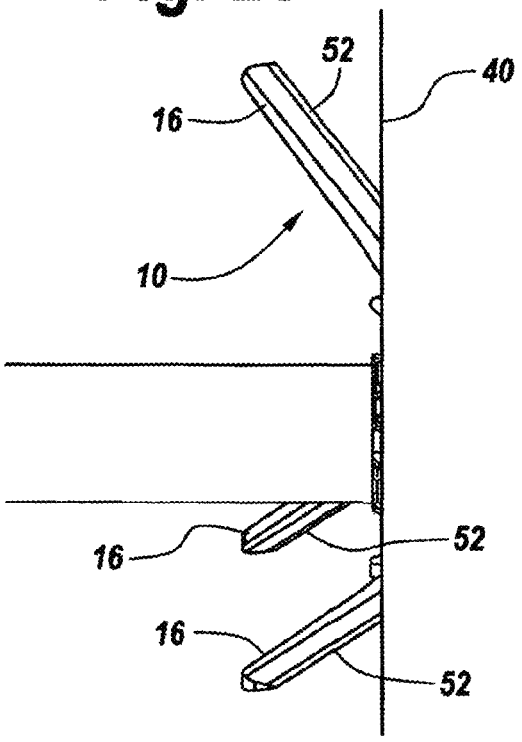

Finally as illustrated at FIG. 2F, broadhead 10 is shown having penetrated target 40 with the outer edges 52 of deployable blades 16 cutting into target 40.

Figure 3:
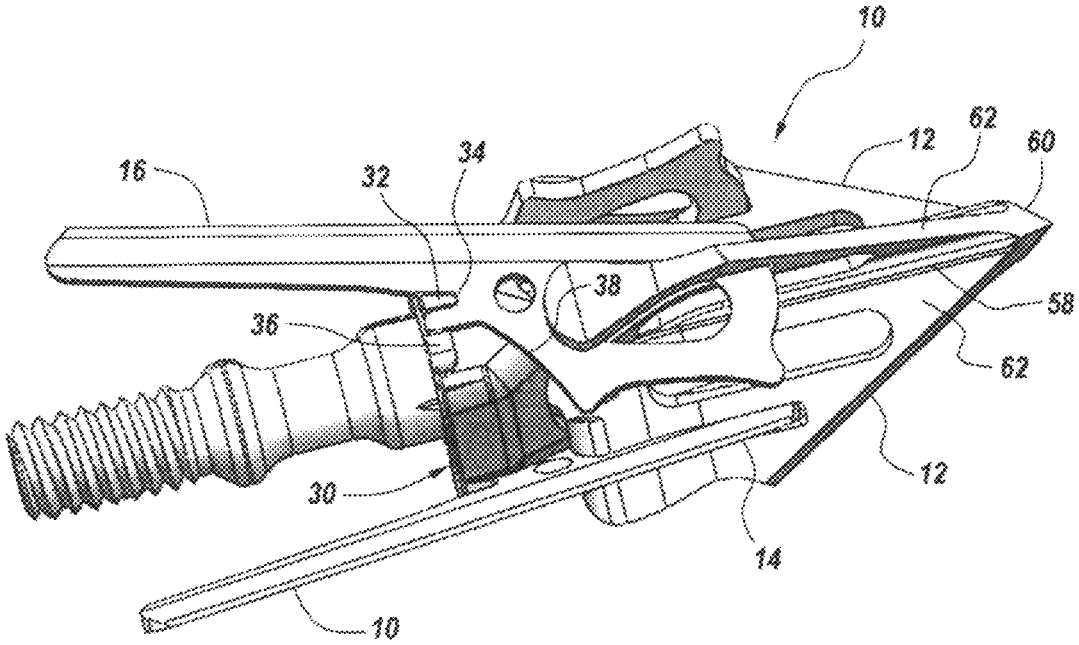
FIG. 3 is a diagrammatic illustration of the broadhead of FIG. 1 illustrating the attachment of the broadhead ferrule screwed into an end of an arrow, also illustrating a shock collar having a camming surface and a frangible tab which breaks upon impact allowing the deployment of the rotatable and translatable blade after impact.

Referring now to FIG. 3, broadhead 10 is shown having fixed blades 12 culminating into a needle sharp tip 60 which is supported by the adjacent fixed blade surfaces 62 such that the tip does not crumple when impacting a target.

This provides the broadhead with increased penetrating power due to the needle-like tip. Here it can be seen that deployable blades 16 reside in channels or grooves 14 in the associated fixed blade. While there could obviously be other workable combinations of blade width and slot clearance, the preferred embodiment has a groove or channel 14 made sufficiently wide such that with a fixed blade width of 0.035" and a channel width of 0.039" provide sufficient clearance to prevent jamming Also shown in FIG. 3 is shock collar 30 that is utilized to absorb blade slap during impact the deployable blades are maintained in position during flight through the utilization of the frangible tab 32 in notch 34. Also shown is the cam following surface 38 which is adapted to cam on camming surface 36 which is part of a specialty washer 33 that is inserted into the aft end of shock collar 30.

Figure 4:
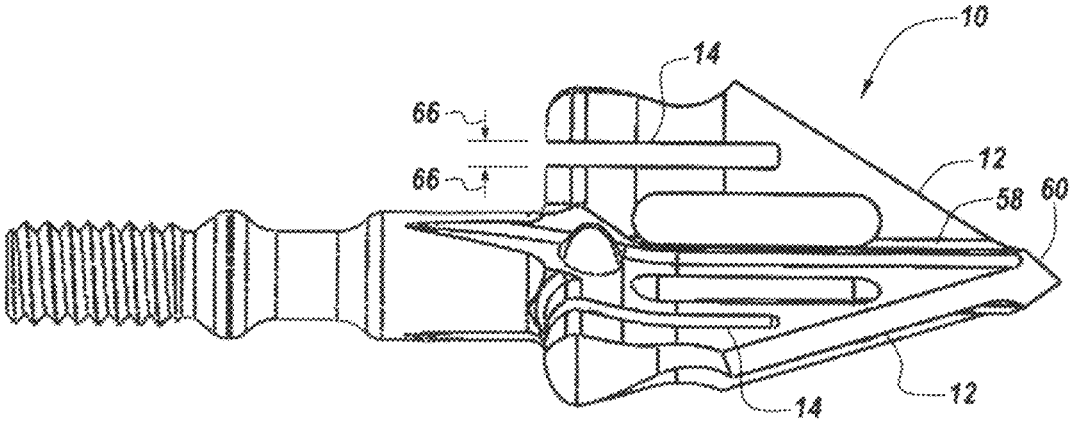
FIG. 4 is a side view of the ferrule and fixed blades of the broadhead of FIG. 3 illustrating the channels in the fixed blade into which are disposed the deployable blades.

Referring to FIG. 4, channel or groove 14 is shown having a width illustrated by arrows 66, clearly sufficient to provide clearance for the translation and rotation of the deployable blades to be placed therein. Thus the translation and rotation of the deployable blades in the channel or groove is not constrained such that the blades will not jam during deployment.

Figure 5:
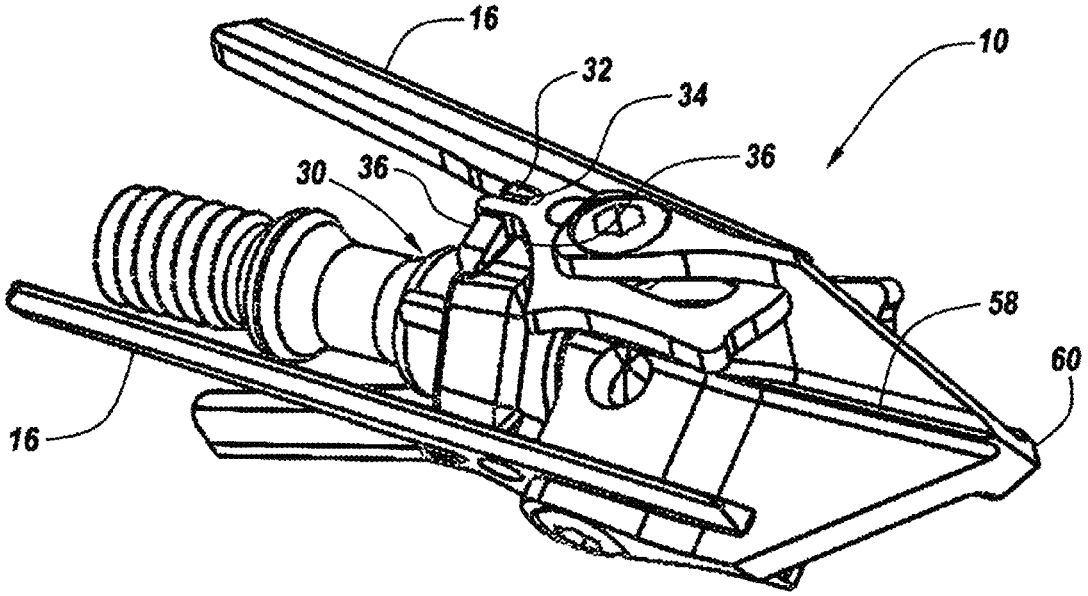
FIG. 5 is an isometric view of the broadhead of FIG. 1 illustrating the capture of the deployable blades in a channel in the fixed blade, also illustrating the needle like point of the broadhead which is supported on at least three sides by the three fixed blades which culminate in the point.

Referring to FIG. 5, here it can be seen in the inflight condition that deployable blades 16 are locked into position by frangible tab 32 on shock collar 30, with the camming surface 36 adjacent cam follower 38.

Figure 6:
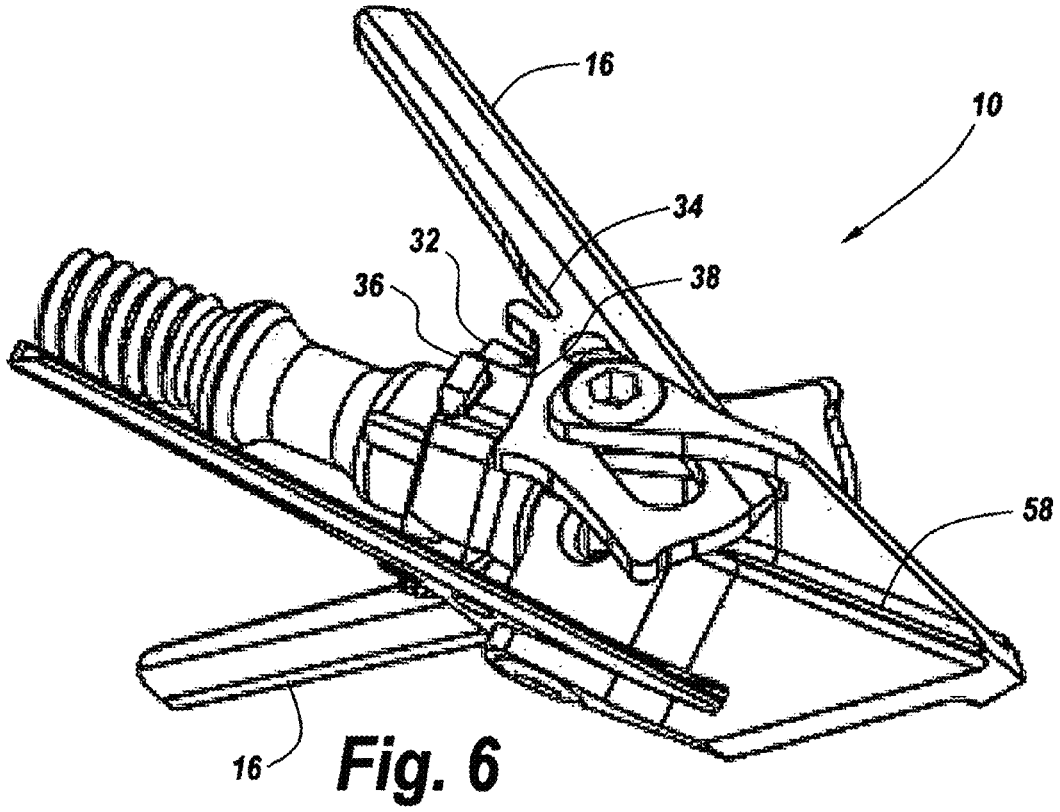
FIG. 6 is a diagrammatic illustration of the broadhead of FIG. 5 illustrating the swinging out of the deployable blades upon impact with a target.

Referring to FIG. 6, upon extension of deployable blades 16 the frangible tab 32 has been sheared off such that it no longer exists in notch 34 in deployable blade 16. Here in the partial deployment of blade 16 the camming surface 36 is not in contact with cam follower 38 as the deployable blade 16 has not moved aft sufficiently for this contact.

Figure 7:
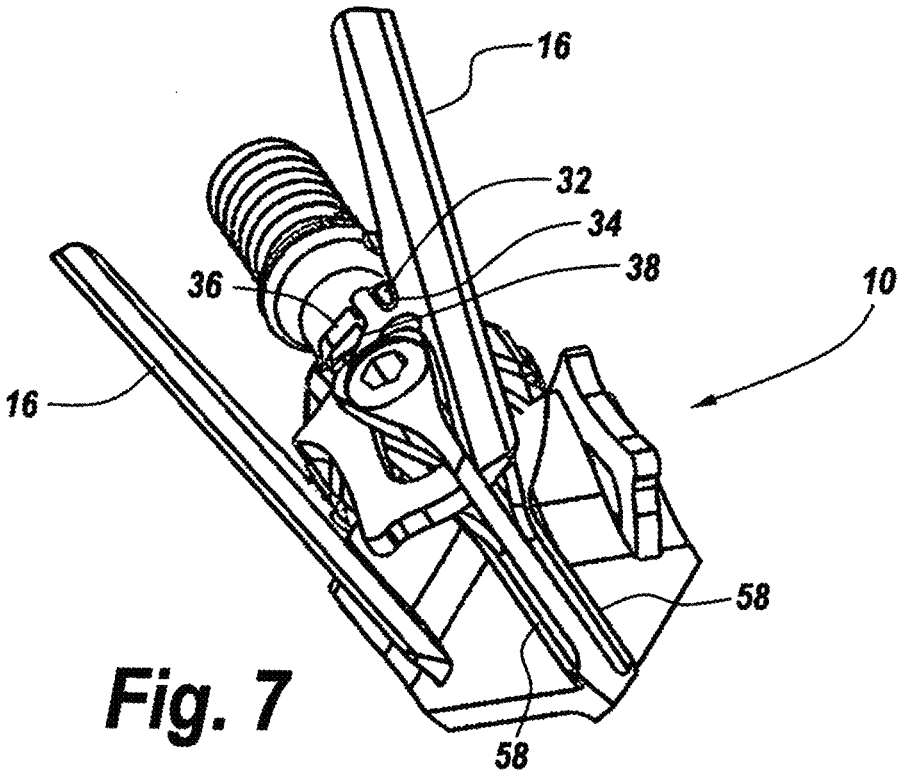
FIG. 7 is an isometric view of the broadhead of FIG. 1 illustrating the deployable blade position in flight, or prior to extension.

Referring to FIG. 7, another view of the broadhead 10 is shown in which deployable blades 16 are shown in their inflight position and locked in place by tabs 32 in notches 34 in the deployable blades. Here it can be seen that camming surface 36 is about to contact cam follower 38 during the expansion of deployable blades 16.

Figure 8:
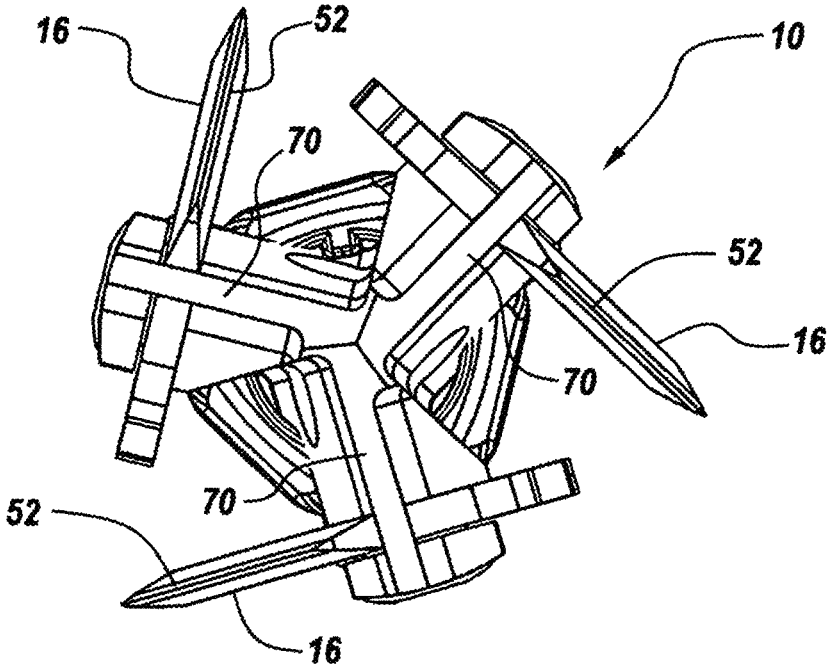
FIG. 8 is a front view of the broadhead of FIG. 7 illustrating the inflight position of the deployable blades with edges facing outward from the centerline of the broadhead.

Referring to FIG. 8, from a front view during the inflight position of broadhead 10 deployable blades 16 are arranged separated by 120 degrees, with the cutting edges 52 facing front and with the cutting edges 70 of the fixed blades also facing front.

Figure 9:
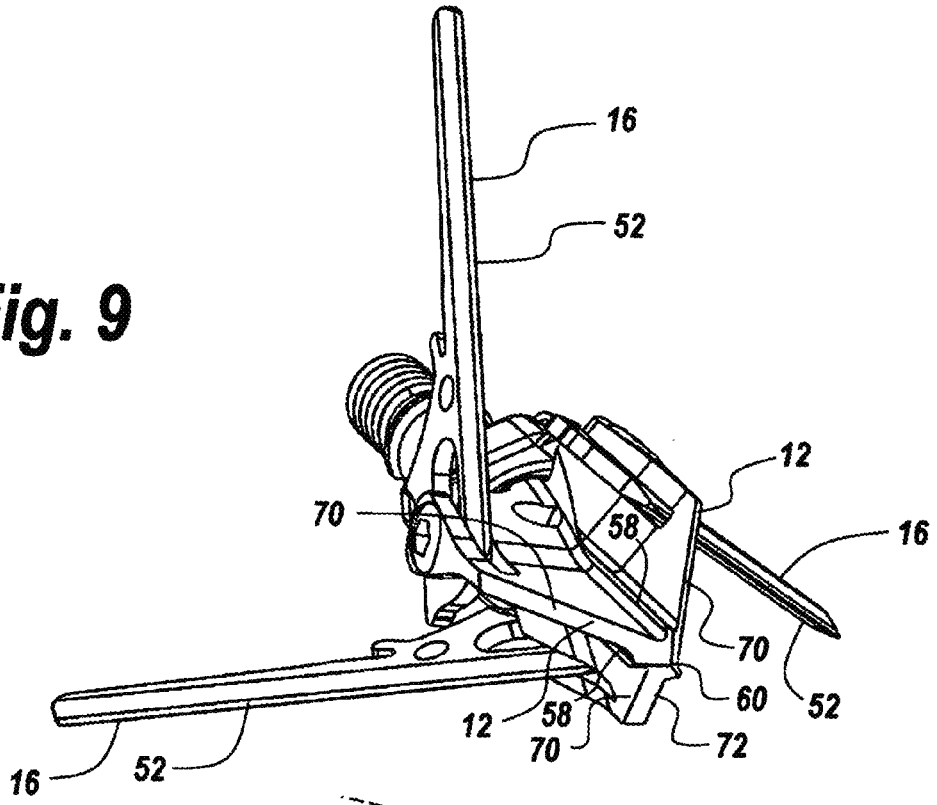
FIG. 9 is an isometric view of the broadhead of FIG. 7 showing the position of the deployable blades extended after target impact.

Referring now to FIG. 9, the fully extended deployable blades 16 are shown with their cutting edges 52 facing front as are the cutting edges 70 of fixed blades 12.

Figure 10:
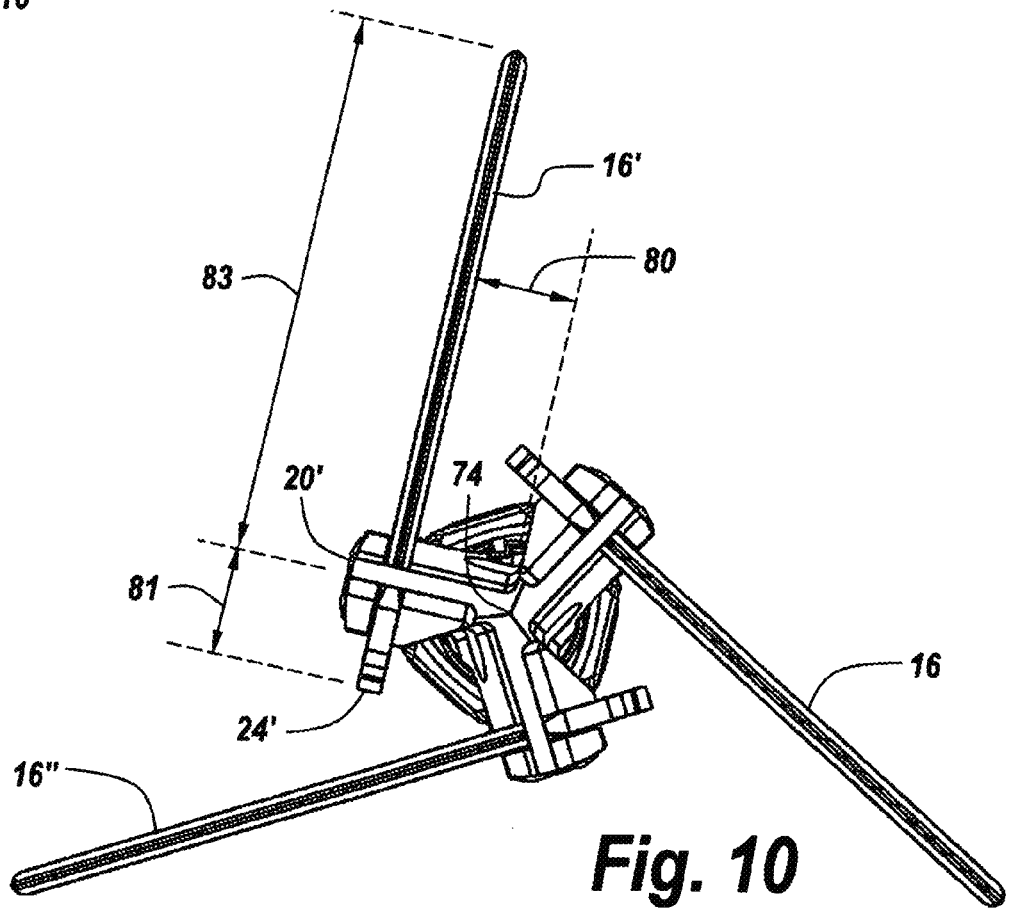
FIG. 10 is a front view of the broadhead of FIG. 9 showing a front view of the extension of the deployable blades, also illustrating the clearance between the blades due to the offset of the fixed retaining pins from the ferrule center axis.

Referring to FIG. 10, from a front point of view the fully extended position of deployable blade 16 is shown with considerable distance between the front shoulder 24' of blade 16' with respect to any portion of blade 16". This clearance is important such that upon deployment the blades do not interfere with one another. The reason for the non-interference has to do with the distance between fixed retaining pin 20' and the center line 74 on which ferrule tip lies. This offset distance illustrated by arrow 80 is what accounts for the clearances between the deployable blades. In one embodiment the distance 80 is 0.328 inches. Note that in one embodiment the distance from front shoulder 24' and the centerline of pin 20' is 0.283", whereas the distance from the centerline of pin 20' and the distal end of blade 16' is 0.290".

Figure 11:
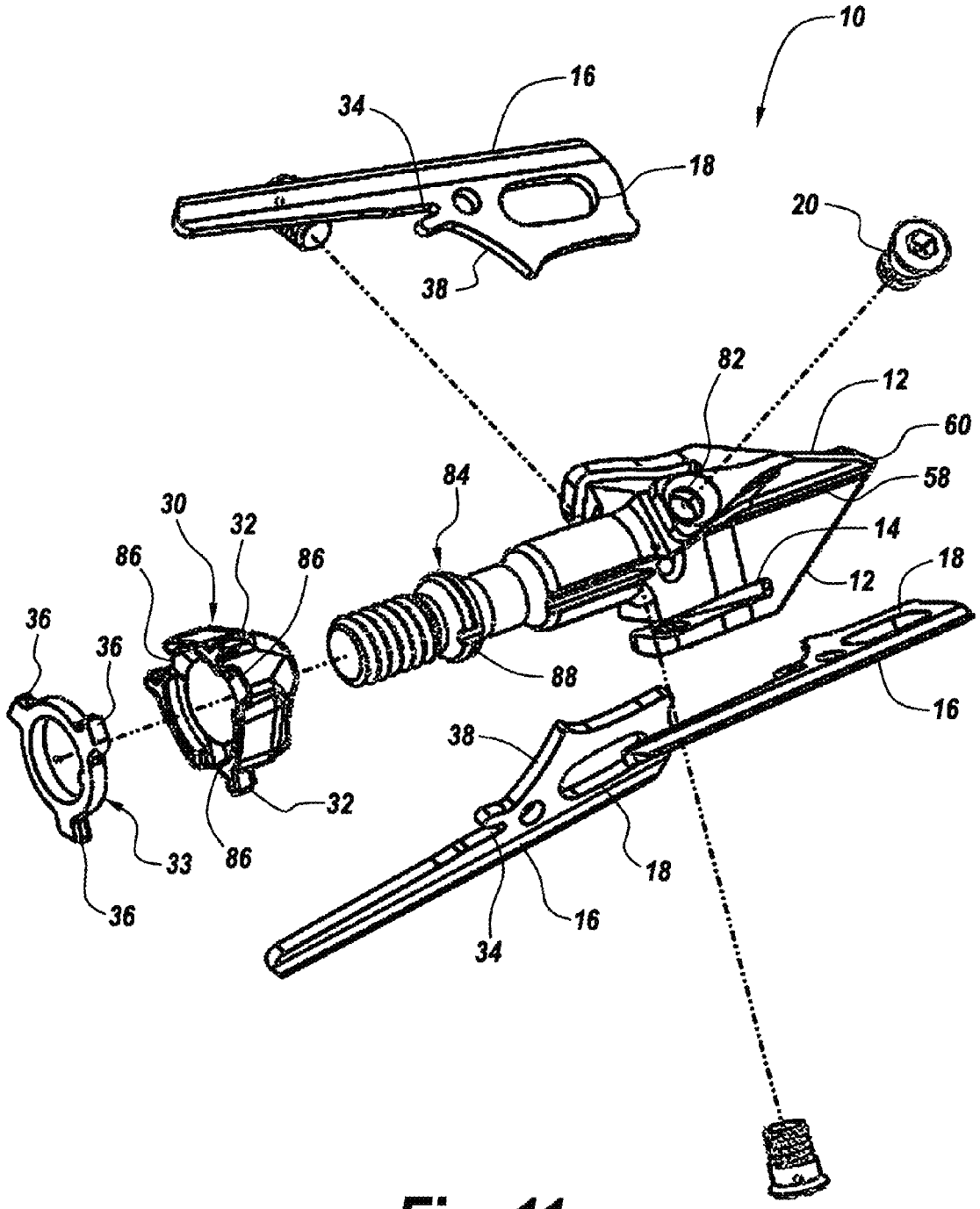
FIG. 11 is an exploded view of the broadhead of FIG. 1 illustrating the fixed blades attached to a central ferrule, deployable blades to be assembled into channels within the fixed blades, retaining pins that retain the deployable blades in the fixed blade channels by the insertion of the pins through channels in the fixed blades, also showing a shock collar and a specialty washer having camming surfaces adapted to coact with rear cam following surfaces of the deployable blades.

Referring now to FIG. 11, how broadhead 10 is constructed can be seen in this exploded diagram in which deployable blades 16 are to be positioned in grooves or channels 14 in fixed blades 12 that cumulate in point 60. Here it can be seen that the deployable 16 are captured in the respective grooves or channels 14 utilizing a fixed retaining pin or fastener 20 which in one embodiment passes through an orifice 82 in fixed blade 12 and through slot 18 in the corresponding deployable blade.

Here it can be seen that shock collar 30 is mounted to broadhead 12 along a central ferrule portion 84, with specialty washer 33 mounted into receiving slots 86 in shock collar 30. It will be noted that specialty washer 33 provides hard camming surfaces 36 which are to communicate with cam followers 38 on the aft portion of associated deployable blades 16, with the shock collar being secured against rotation about ferrule portion 84 in a tongue and groove structure illustrated by grooves 88 on the ferrule. Note also that frangible tabs 32 are integrally formed in shock collar 30.

Figure 12:
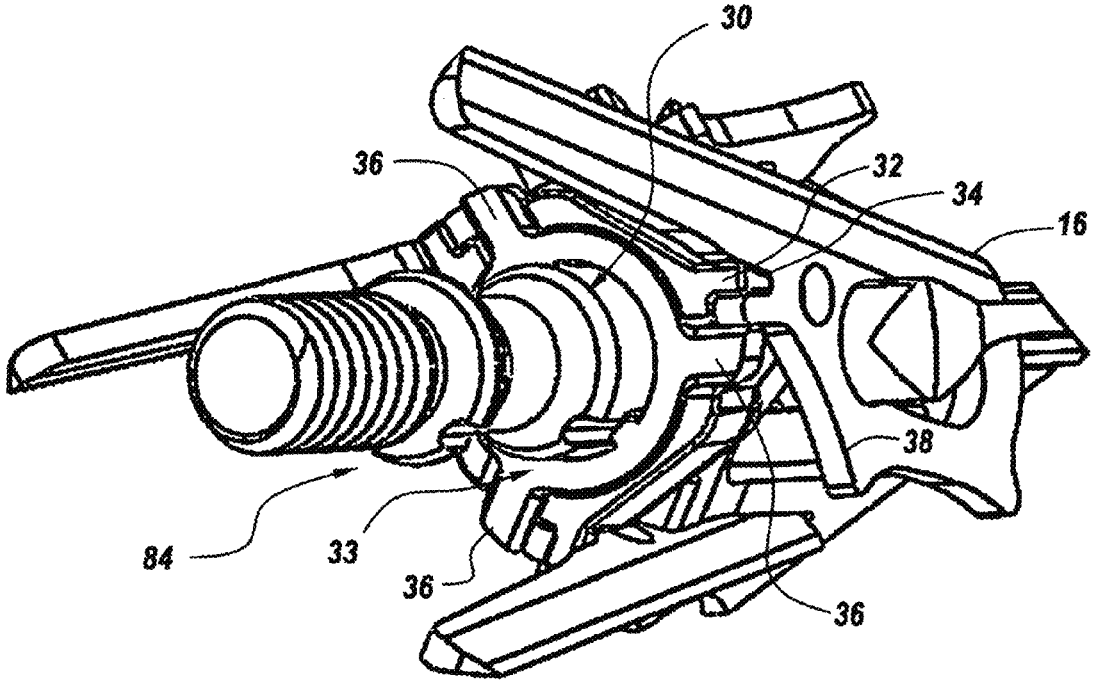
FIG. 12 is a diagrammatic illustration of the broadhead assembled in accordance with the exploded view of FIG. 11 illustrating the shock collar and specialty washer in place on the ferrule, also illustrating the positioning of a frangible protruding tab on the shock collar and the camming surface of the specialty washer adjacent an associated deployable blade.

Referring to FIG. 12, it can be seen that shock collar 30 is in place on ferrule portion 84 such that frangible tab 32 is within notch 34 on deployable blade 16. Here it can clearly be seen that specialty washer 33 has camming surfaces 36 in respective grooves on the shock collar that in turn communicate with cam followers 38 on the aft portion of deployable blades 16.

Figure 13:
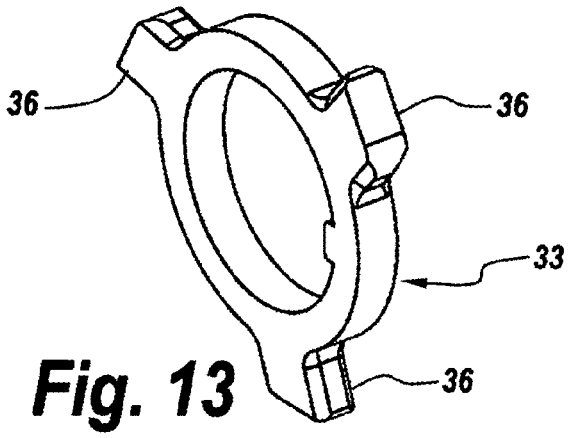
FIG. 13 is a diagrammatic illustration of the specialty washer of FIG. 11.

Referring to FIG. 13, specialty washer 33 is shown having camming surfaces 36 clearly indicated around the periphery of the specialty washer.

Figure 14A:
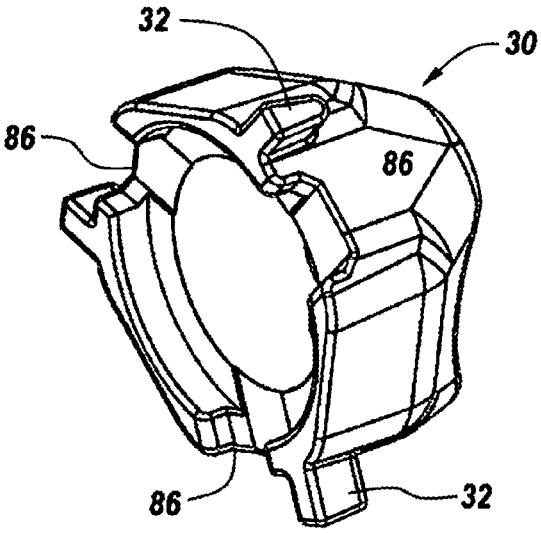
FIGS. 14A, 14B and 14C are various isometric views of the shock collar of FIG. 11.
Figure 14B:
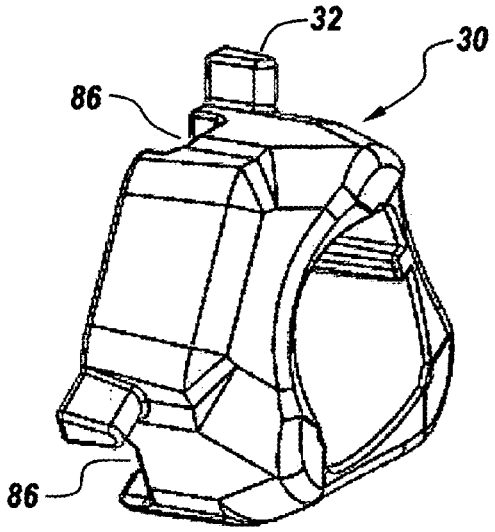
Figure 14C:
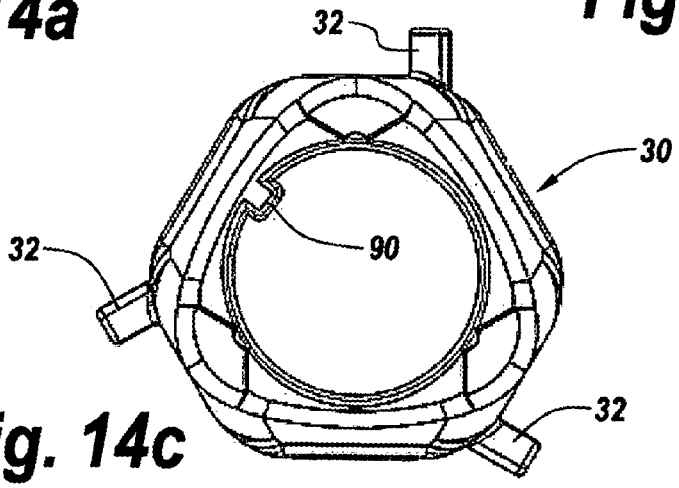

Referring to FIGS. 14A, 14B and 14C shock collar 30 is provided with frangible tabs 32 around its periphery, also showing grooves 86 adapted to receive camming surfaces 36 therein when specialty washer 33 is inserted into the aft end of the shock collar.

As shown in 14C an internal rib 90 is utilized as a key to prevent rotation of the shock collar on ferrule portion 84 due to its cooperation with slots 88 of FIG. 11.

Figure 15:
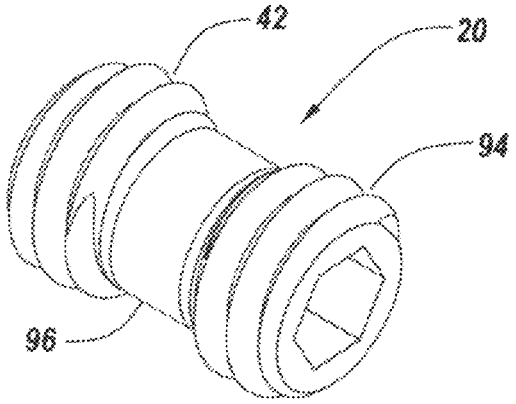
FIG. 15 is a diagrammatic illustration of a fixed retaining pin for use in the broadhead of FIG. 1.

Referring now to FIG. 15, in one embodiment fixed retaining pin 20 has threaded end portions 92 and 94 and a central unthreaded portion 96.

Figure 16:
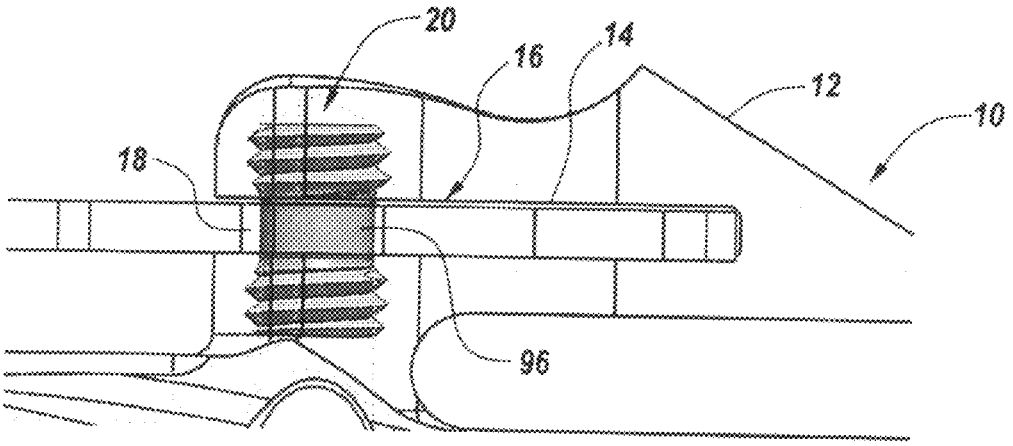
FIG. 16 is a cross sectional view of a broadhead utilizing the fixed retaining pin of FIG. 15 that transverses a channel in the fixed blade of the broadhead, illustrating threaded ends and an unthreaded central shank portion of the fixed retaining pin; and, FIG. 17 is a diagrammatic illustration of an alternative embodiment of the fixed retaining pin of FIG. 15.

Referring to FIG. 16, when retaining pin 20 is screwed into groove or channel 14 in fixed blade 12, slot 18 in deployable blade 16 rides on the unthreaded portion 96 of fixed retaining pin 20.

Thus the extension of the deployable blade as it rotates and translates on fixed retaining pin 20 does not come into contact with any threaded portion of the fixed retaining pin. As a result it is possible to remove and replace the deployable blades by simply unscrewing the fixed retaining pin since its movement out of channel 14 in fixed blade 12 is not impeded by shards of metal that may be removed from threads on the pin during blade slap should the pin be fully threaded during the impact slap when the broadhead impacts the target.

Figure 17:
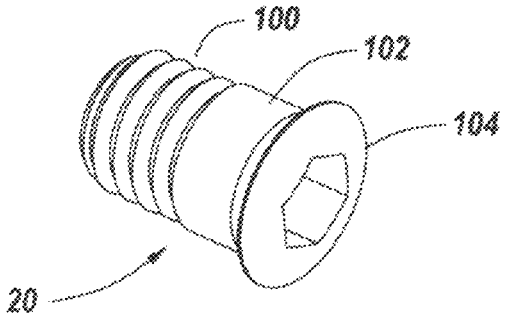

Referring now to FIG. 17, an alternative embodiment of retaining pin 20 is shown with a threaded end portion 100 and an unthreaded central portion 102 adjacent a retaining pin head 104. It will be appreciated that the unthreaded portion 102 resides in the channel or slot in the fixed blade such that, as in the prior embodiment, the slapping of the auxiliary blade during extension does not result in shavings or filings in the threaded portion. Thus this retaining pin and blade are also easy to remove to allow replacement of the auxiliary blades.

As to the materials of the broadhead first and foremost the fixed blade is preferably made of any number of grades of steel, stainless steel or titanium with example grades of 12L14 steel, 4140 steel, 420 stainless steel, Ti6Al4V titanium, or grade 2 titanium whereas the deployable blades are preferably made of a martensitic grade of stainless steel such as 420 or 440 stainless. The shock collar is made of shock absorbing material nylon, polypropylene, glass filled nylon, polycarbonate, aluminum, zinc or ceramic such as $Al_2O_3$ with the material also providing that the tabs returned in making notches are frangible whereas the specialty washer which contains the camming surfaces is made of a hard and tough material such as austenitic grades of stainless steel such as 301 or 304 stainless, or martensitic stainless steel such as 420 or 440 stainless, or steel grades such as 4340 or 4140.

While the present invention has been described in connection with the preferred embodiments of the various figures, it is to be understood that other similar embodiments may be used or modifications or additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. An expandable broadhead, comprising:

a plurality of fixed blades;

a plurality of retaining pins; and a plurality of rear-deploying blades;

wherein:

each of the plurality of retaining pins is inserted into a respective fixed blade;

each of the plurality of rear-deploying blades is mounted on a respective retaining pin; and each of the plurality of rear-deploying blades comprises a slot configured to translate and rotate on a respective retaining pin.

2. The expandable broadhead of claim 1, wherein the plurality of fixed blades meet at a tip of the expandable broadhead.

3. The expandable broadhead of claim 1, wherein each of the plurality of fixed blades comprises a channel configured to house a rear-deploying blade.

4. The expandable broadhead of claim 1, wherein each of the plurality of retaining pins comprises a threaded end portion and an unthreaded central portion.

5. The expandable broadhead of claim 1, wherein the plurality of fixed blades comprises three fixed blades, the plurality of retaining pins comprises three retaining pins, and the plurality of rear-deploying blades comprises three rear-deploying blades.

* * * * *